US007331163B2

(12) United States Patent
Hau et al.

(10) Patent No.: US 7,331,163 B2
(45) Date of Patent: Feb. 19, 2008

(54) REFRIGERATOR WITH INTEGRAL VACUUM SEALER

(76) Inventors: Joseph A. Hau, 1607 Randallwood Rd., Jarrettsville, MD (US) 21014; Sephanie Hau Novak, 1607 Randallwood Rd., Jarrettsville, MD (US) 21014

( * ) Notice: Subject to any disclaimer, the term of this patent is extended or adjusted under 35 U.S.C. 154(b) by 0 days.

(21) Appl. No.: 11/262,706

(22) Filed: Oct. 31, 2005

(65) Prior Publication Data

US 2006/0090427 A1 May 4, 2006

Related U.S. Application Data

(60) Provisional application No. 60/623,396, filed on Oct. 29, 2004.

(51) Int. Cl.
*B65B 3/04* (2006.01)
*F25D 23/12* (2006.01)

(52) U.S. Cl. ..... 53/512; 53/88; 53/408; 62/331; 99/472

(58) Field of Classification Search ..... 53/79, 53/88, 84, 512, 432, 405, 408; 62/331; 99/472, 99/455; *F25D 23/12*
See application file for complete search history.

(56) References Cited

U.S. PATENT DOCUMENTS

| | | | | | |
|---|---|---|---|---|---|
| 2,054,724 | A | * | 9/1936 | Fulton | 62/136 |
| 2,116,813 | A | * | 5/1938 | O'N Weisser et al. | 99/472 |
| 2,119,320 | A | * | 5/1938 | Dobrowsky | 99/472 |
| 2,894,845 | A | * | 7/1959 | Stoddard | 426/419 |
| 3,216,214 | A | * | 11/1965 | Luciano | 62/170 |
| 5,095,717 | A | * | 3/1992 | Germi | 62/382 |
| 5,136,853 | A | * | 8/1992 | Girardon et al. | 62/78 |
| 5,157,940 | A | * | 10/1992 | Bertu et al. | 62/382 |
| 5,271,240 | A | * | 12/1993 | Detrick et al. | 62/268 |
| 5,398,811 | A | | 3/1995 | Latella, Jr. | |
| 5,425,816 | A | * | 6/1995 | Cavicchi et al. | 438/98 |
| 5,494,165 | A | * | 2/1996 | Detrick | 206/524.8 |
| 5,893,822 | A | * | 4/1999 | Deni et al. | 53/512 |
| 6,090,422 | A | * | 7/2000 | Taragan et al. | 426/231 |
| 6,148,875 | A | * | 11/2000 | Breen | 141/65 |
| 6,256,968 | B1 | | 7/2001 | Kristen | |
| 6,694,710 | B2 | | 2/2004 | Wang | |
| 2002/0083724 | A1 | * | 7/2002 | Tarlow et al. | 62/131 |
| 2003/0000180 | A1 | | 1/2003 | Singer | |
| 2006/0010890 | A1 | * | 1/2006 | Feinauer et al. | 62/169 |

* cited by examiner

*Primary Examiner*—Rinaldi I. Rada
*Assistant Examiner*—Paul Durand
(74) *Attorney, Agent, or Firm*—Ober/Kaler; Royal W. Craig

(57) ABSTRACT

The present invention is a vacuum packaging system that is comprised of a very convenient vacuum pump and canister-sealing device that is an integral component of a refrigerator. The device is comprised of: 1) one or more external vacuum hose input ports or retractable combination hose/input ports, for applying a vacuum for packaging canisters, bottles or jars, or a remote bag sealing unit; 2) an internal configuration comprised of one or more vacuum hose input ports or retractable combination hose/input ports, canister lid storage attachments and/or carousel storage attachments; and/or 3) an external, integral or removable bagging unit (recessed into the refrigerator door) for vacuum sealing and cutting plastic bagging material.

8 Claims, 4 Drawing Sheets

REFRIGERATOR WITH INTEGRAL VACUUM SEALER

CROSS-REFERENCE TO RELATED APPLICATIONS

The present application derives priority from U.S. Provisional Patent Application No. 60/623,396; filed Oct. 29, 2004.

BACKGROUND OF THE INVENTION

1. Field of the Invention

The present invention relates to refrigerators and, more particularly, to a refrigerator with an integrated vacuum sealer for vacuum packing food or other items.

2. Description of the Background

Oxygen in air promotes certain reactions in foods that cause deterioration of quality. For example, oxygen can cause fats in food to go rancid as well as cause certain odor and color changes. Therefore, removal of oxygen from the package environment will preserve certain quality characteristics and extend the food's shelf life. Vacuum packing and sealing is thus a means of food preservation that preserves food for a greater period of time than conventional plastic wrap or storage bags. Vacuum sealers are commonly used to extend the storage time of refrigerated, dried and frozen foods. In addition to extending the storage time, storing food in vacuum-sealed plastic bags optimizes food storage space.

There currently exist a number of food vacuum sealing devices that are comprised of counter-top appliances, or are designed as impractical and bulky internal storage bins, much like traditional crispers. Counter-top devices can complete a vacuum seal of thermoplastic bags or canisters; however, these devices lack the convenience provided by the present invention. The currently existing vacuum sealing devices must be stored in cabinets or on the counter top, taking up valuable counter or storage space. In addition, these devices must be plugged into a wall outlet, and when not in use, the power cord and attachments must be inconveniently stowed. Lastly, when the user wishes to remove only a portion of the food in the re-sealable container, he/she is required to retrieve the appliance from storage, clear a working space, extract the power cord, and proceed with a number of cumbersome steps simply to reseal the container.

Integrating a vacuum sealer system into a refrigerator would clear up counter space as well as position the vacuum sealer in an easily accessible location.

U.S. Pat. No. 6,148,875 to Breen issued Nov. 21, 2000 discloses a Vacuum Food Storage System integrated into a refrigerator. Specifically, it discloses a sealed refrigerator storage container (i.e. the fruit, vegetable, or meat drawer) and vacuum pump for evacuating the air from the internal storage container. Once the drawer is closed, the vacuum pumps out the air until a preset pressure is met. The drawer contains a mechanism to release the pressure in order to open the drawer and retrieve the food. This vacuum food storage system may be retrofitted into an existing refrigerator or freezer or built into a newly manufactured refrigerator or freezer.

United States Patent Application Publication No. 20030000180 to Singer, filed on Jan. 2, 2003, discloses a vacuum sealer for a bag with a feature that assists in keeping the bag mouth from being sucked shut before air evacuation is complete. An anvil and a sealer bar form a weld across the bag adjacent its open mouth after evacuation. While not specifically addressed, the device appears to be designed as a separate unit.

U.S. Pat. No. 5,398,811 to Latella issued on Mar. 21, 1995, discloses a sealed food storage canister integrally formed with a hand operated vacuum pump.

U.S. Pat. No. 6,694,710 to Wang issued Feb. 24, 2004, discloses a stand-alone machine for vacuuming the air out of and sealing food containing plastic bags in order to keep the food fresh. The vacuum bag sealing machine comprises a main body; a static sealing unit including an upper and a lower sealing strip, a vacuum generating unit, including a vacuum pump and an exhaust tubule, and a heating and opening-sealing unit. The vacuum pump communicates with a number of through holes formed in the lower sealing strip through the exhaust tubule. The vacuum bag-sealing machine is improved in the static sealing unit and the vacuum-generating unit, so that it has an increased sealing reliability and a quickened vacuuming speed.

U.S. Pat. No. 6,256,968 to Kristen issued Jul. 10, 2001 is the volumetric vacuum control used in the Tilia, Inc. FoodSaver® units. Sensors are provided to detect preset vacuum levels as a container is being evacuated. The control of the vacuum level is self-regulating, and compensates for atmospheric conditions, altitudes or pumping capacities. FoodSaver® appliances are typically configured to be used with a variety of bag sizes or with rolls to create custom size packages.

None of the above prior art references discloses a refrigerator with an integral vacuum-sealer food storage system including a vacuum pump and either a vacuum hose input port for vacuum packaging canisters, bottles or jars and/or an integral plastic pouch vacuum sealer.

Therefore, it would be advantageous over the prior art to provide a refrigerator with a built-in vacuum-sealer food storage system that is recessed into the refrigerator door for easy and convenient access, while no longer taking up valuable counter space. This would eliminate the inconvenience of sealing and resealing both bags and canisters with a stand-alone appliance. The user could remove a small portion of preserved food for the use at hand, and quickly and conveniently re-seal a container in a matter of moments. Finally, as an integral part of the refrigerator, the device could look natural and complimentary.

SUMMARY OF THE INVENTION

It is, therefore, an object of the present invention to provide a refrigerator with an integral vacuum sealer for vacuum packaging foods or other items.

It is another object of the present invention to provide a refrigerator with an integral vacuum sealer wherein the vacuum sealer is either retrofit into exiting refrigerators or integrated into newly manufactured refrigerators.

It is another object of the present invention to provide a refrigerator with a removable vacuum sealer that can be used either attached to an existing refrigerator or detached for countertop use.

It is still another object to provide a refrigerator with a vacuum sealer suited for sealing vacuum bags and/or vacuum canisters.

It is yet another object of the present invention to provide such a combination refrigerator-vacuum sealer that is convenient to use and easily accessible.

These and other objects of the present invention are accomplished by providing a combination refrigerator-vacuum sealer comprised of a vacuum pressure component, a sealing component, and a vacuum pump control switch.

The vacuum pressure component includes either a dedicated vacuum pump or a system that derives vacuum pressure from the refrigerator's internal compressor. In the preferred embodiment the vacuum pressure component is contained in a motor housing located in the back of the refrigerator and is comprised of an electric motor which operates a vacuum pump piston assembly. An intake vacuum hose carries suctioned air into the pump from the vacuum sealing component and an output vacuum hose carries exhaust air away from the pump and out an exhaust port.

The sealing component may be comprised of any of the following alternatives, alone or in combination: 1) a basic configuration comprised of one or more external vacuum hose input ports or retractable combination hose/input ports, for applying a vacuum for packaging canisters, bottles or jars, or a remote bag sealing unit; 2) an internal configuration comprised of one or more vacuum hose input ports or retractable combination hose/input ports, canister lid storage attachments and/or carousel storage attachments; and/or 3) an external, integral or removable bagging unit (recessed into the refrigerator door) for vacuum sealing and cutting plastic bagging material. For the vacuum hose input port(s) (embodiment #2) one or more internal ports are beneficial because they allow a user to detach the lid from the canister inside the refrigerator, remove the food from the canister, then reattach the lid and seal the canister all while inside the refrigerator. In embodiment #3, the bagging unit can be used as a separate counter top plastic-bag sealing unit connected by hose to the vacuum pressure component.

Variations in the materials and construction may be incorporated without departing from the inventive concept presented herein.

BRIEF DESCRIPTION OF THE DRAWINGS

The above and other objects, features and advantages of the present invention will become more apparent from the following detailed description of the preferred embodiments and certain modifications thereof when considered in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

A refrigerator with integral vacuum sealer is disclosed for conveniently vacuum packaging foods or other items (coffee, etc.) by sealing them in vacuum bags and/or vacuum canisters. The vacuum sealer may be installed as a retrofit kit into exiting refrigerators, or integrated as original equipment in newly manufactured refrigerators. Moreover, in one embodiment the vacuum sealer is detachable from the refrigerator for dual use, either in the refrigerator itself or removed for remote countertop use. This provides a vacuum sealing function not found in existing refrigerators that is more convenient to use and easily and instantly accessible. Generally, the vacuum sealer includes a vacuum source plus any of the following sealing-unit alternatives, alone or in combination:

1) at least one air intake port panel-mounted on the refrigerator for receiving a vacuum hose for vacuum packaging canisters, bottles or jars; and
2) a bagging unit for vacuum sealing and cutting plastic bagging material. The bagging unit may be a remote bagging unit for remote counter top plastic-bag sealing that is connectable by hose to any of the above-described air intake ports, or may be an integral bagging unit likewise recessed into the front of the refrigerator 2 door for vacuum sealing and cutting plastic bagging material. In addition, the bagging unit may be a detachable console for dual use either as a remote counter top unit or an integral bagging unit.

Figure 1:
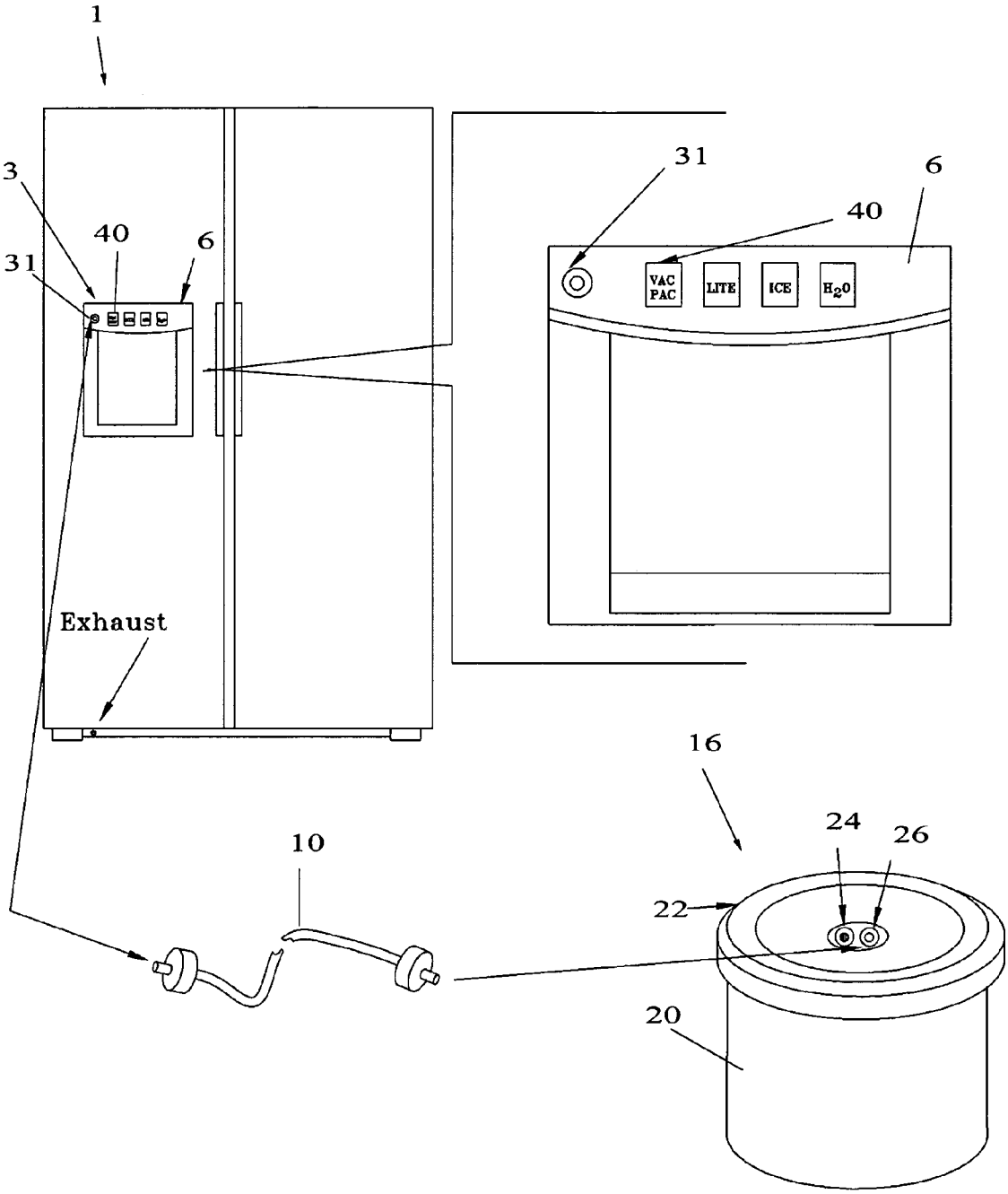
FIG. 1 is a front view illustration of the combination refrigerator-vacuum sealer 1 of the present invention according to one basic embodiment.

FIG. 1 is a front view illustration of the combination refrigerator-vacuum sealer 1 of the present invention according to one basic embodiment comprising a vacuum sealer 3 having a vacuum hose input port 31 and a vacuum control switch 40 incorporated into the existing ice maker panel 12 of a conventional refrigerator 2 for sealing vacuum canisters 16, vacuum bags, or other jars, bottles, bags, or bagging material. An enlarged illustration of the hose input port 31 and a vacuum control switch 40 incorporated into the existing ice maker panel is provided at top right, and an illustration is provided at bottom showing how the hose input port 31 is connected via vacuum hose 10 to a vacuum canister 16 for sealing thereof. The vacuum hose 10 may be a discrete component, or may be a retractable hose stored in ice-maker panel 6. The illustrated vacuum hose 10 is a discrete component comprising a length of low-pressure tubing having friction-fit seals at both ends for fluid connection to the hose input port 31 and vacuum canister 16. The vacuum canister 16 comprises an open topped enclosure 20 topped by a sealing cap 22 (which may be a conventional vacuum packaging lid), the sealing cap having a vacuum vent port 26 and vacuum hose connection port 24 (for insertion of one end of vacuum hose 10) mounted there atop.

The vacuum sealer 3 may derive vacuum pressure from the existing refrigerator compressor or, alternatively, may include its own vacuum pump (as will be described). In the latter case the vacuum sealer 3 may either be retrofit into an existing refrigerator 2 or integrated into a newly manufactured refrigerator.

The intake port 31 is configured for receiving the other end of vacuum hose 10 for vacuum packaging canisters 16, bottles or jars (not shown), or for powering a remote bagging unit for vacuum sealing and cutting plastic bagging material (to be described). The vacuum hose input port 31 as well as the vacuum control switch 40 of this embodiment are preferably recessed into the control panel 6 of a conventional ice and water dispenser. In use, the food item(s) to be vacuum packaged are placed inside the base 20 of canister 16, the sealing cap is placed atop the base 20, one end of vacuum hose 10 is attached to the vacuum hose connection port 24, and the other end of the hose is attached to vacuum hose input port 31 the appliance 2. Once the vacuum control switch 40 is operated, the integral vacuum sealer 3 applies a predetermined vacuum pressure to the canister 16 for keeping foods fresh longer than they would remain in their original containers.

Figure 2:
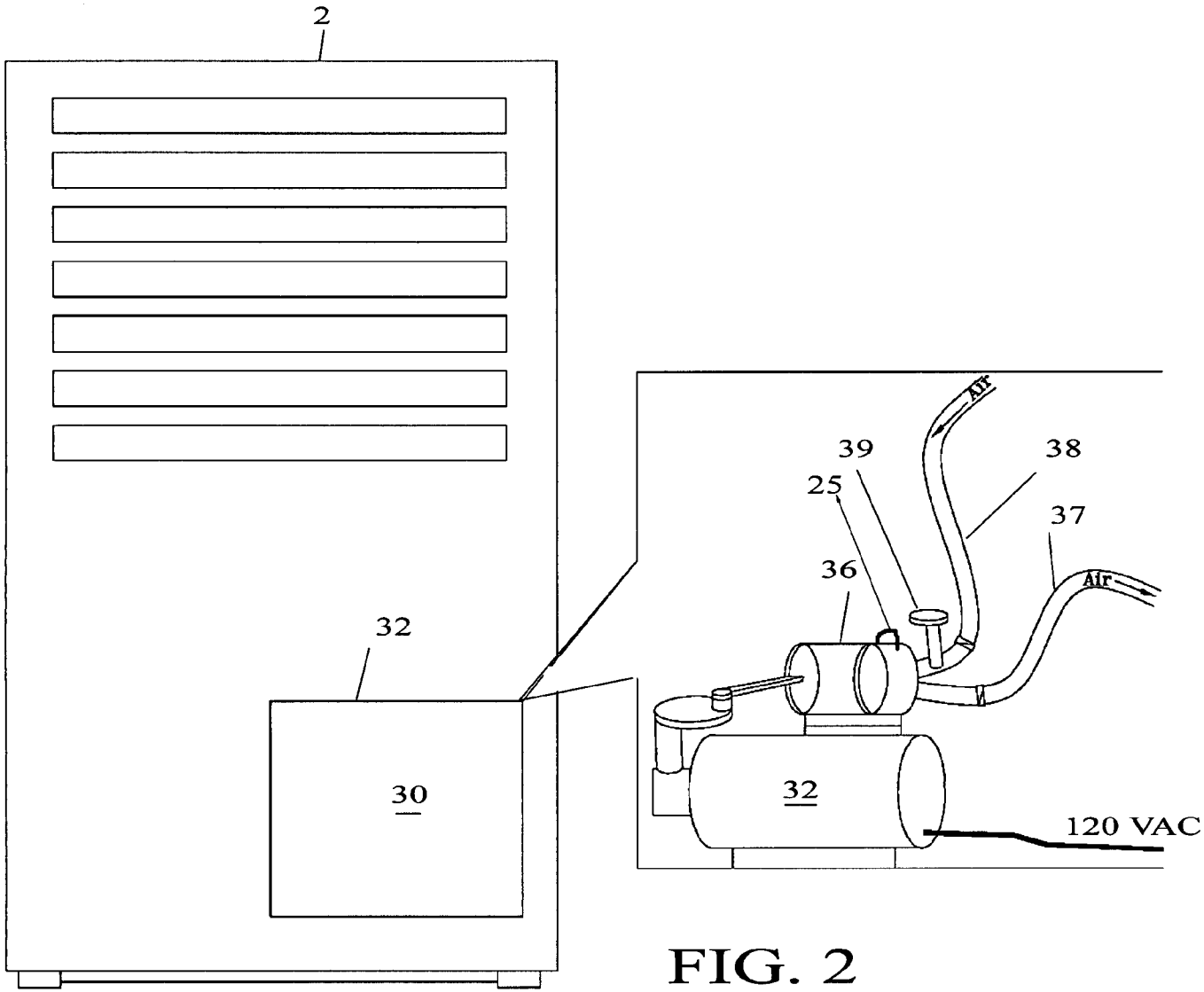
FIG. 2 is a rear view of the refrigerator 2 illustrating a preferred embodiment of dedicated vacuum source 30.

FIG. 2 is a rear view of the refrigerator 2 illustrating a preferred embodiment of the vacuum source, which is a dedicated vacuum source 30 installed in the under cabinet of the refrigerator 2 (in the compressor compartment). As shown in the enlarged inset (right), the dedicated vacuum source 30 comprises a housing 32 mounted in the back of the refrigerator 2, and an electric motor 34, which drives a vacuum pump piston assembly 36. Piston assembly 36 outputs a regulated vacuum pressure through one or more vacuum tubes 38 connected internally to the vacuum hose input port(s) 31 at the front of the refrigerator 2 (FIG. 1). Electric motor 34 may be any conventional electric motor, preferably operative directly from 120 VAC or with on-board circuitry for operation from stepped down regulated AC. Piston assembly 36 is preferably a nylon single-piston pump for producing between 20 in. and 24 in. Hg, a variety of which are commercially available. Electric motor 34 is controlled by the control switch 40 (See FIGS. 1-2) and operates the vacuum pump piston assembly 36 to create vacuum pressure. The vacuum tube(s) 38 carry suctioned air to the intake ports 31 (See FIGS. 1-2). An output vacuum hose 37 carries exhaust air away from the piston assembly 36 and out an exhaust port. The exhaust port is ideally located in a position on the refrigerator 2 that is easily accessible (for maintenance) but inconspicuous (for aesthetics). For example, the exhaust port may be located beneath the refrigerator door at the front of the refrigerator 2 (see FIGS. 1-2). Again referring to FIG. 3, one-way check valve 39 is connected to the vacuum tube 38 to prevent air backflow. Preferably, the piston assembly 36 is equipped with a pressure sensor 25 to detect and turn off the motor 34 once the appropriate vacuum pressure is reached. In this manner, dedicated vacuum source 30 provides vacuum pressure directly and exclusively to the vacuum hose input port(s) 31 at the front of the refrigerator 2 (FIG. 1).

Figure 3:
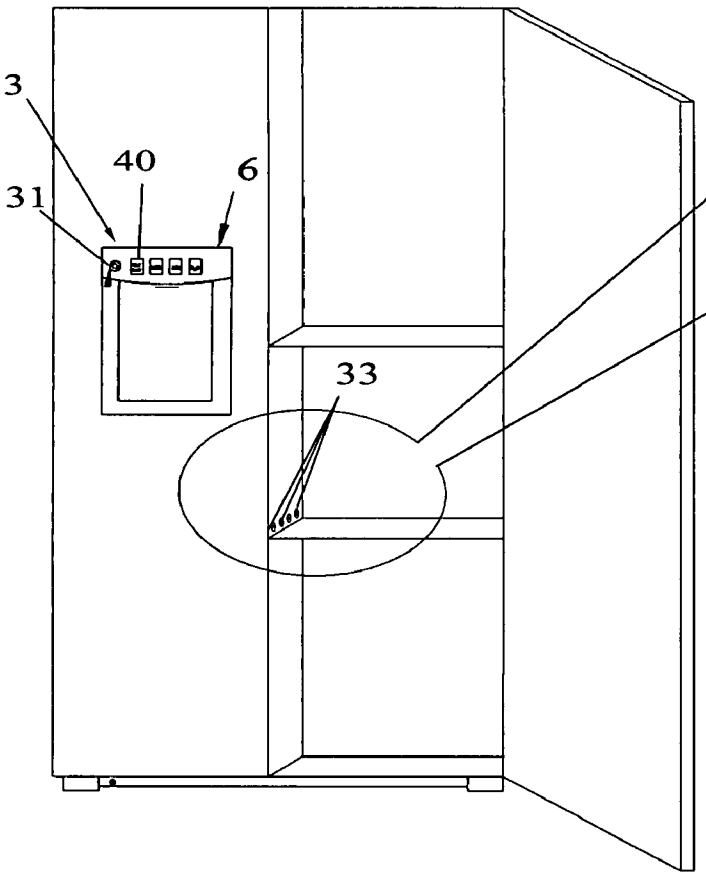
FIG. 3 is a front view of the refrigerator 2 with open door and illustrating that additional vacuum tubes 38 may be routed into the refrigerator main compartment.

FIG. 3 is a front view of the refrigerator 2 with open door and illustrating that additional vacuum tubes 38 may be routed into the refrigerator main compartment to interior vacuum hose input port(s) 33 panel-mounted inside the refrigerator 2 for additional convenience. As seen in the enlarged inset (top right), one or more interior vacuum hose input port(s) 33 are preferably panel-mounted inside the refrigerator 2 just above an interior shelf. The intake ports 33 are configured for receiving a like vacuum hose 10 for vacuum packaging a set of like canisters 16 (or bottles, jars, etc.) while residing on the shelf. In use, the food item(s) to be vacuum packaged are placed inside the canisters 16, the sealing cap is placed atop the base 20, one end of vacuum hose 10 is attached to the vacuum hose connection port 24, and the other end of the hose is attached to vacuum hose input port 33 inside the appliance 2. As before, the vacuum control switch 40 is operated, the integral vacuum sealer 3 applies a predetermined vacuum pressure to the canister(s) 16 for keeping foods fresh longer than they would remain in their original containers. Mounting clips 23 may be provided on the vertical walls inside the refrigerator 2 to maintain the canister lids 22 in a convenient out-of-the-way location.

Figure 4:
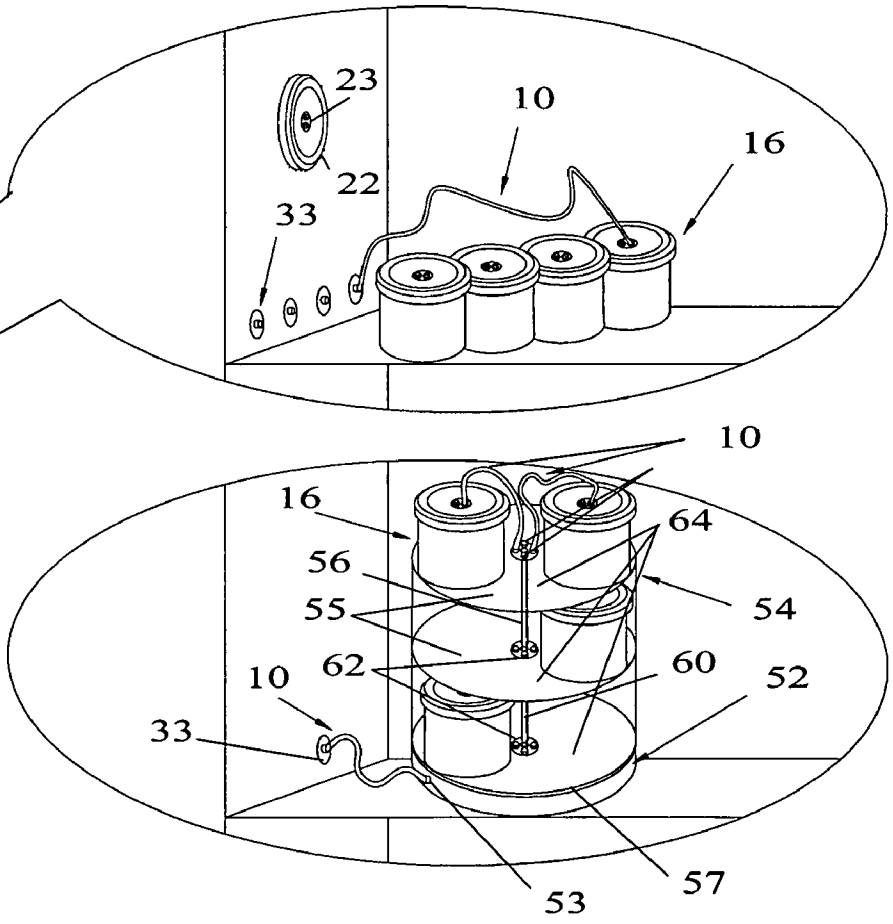
FIG. 4 illustrates an optional carousel assembly 50 used for multiple distribution from a single an interior vacuum hose input port 33.

To reduce the clutter of vacuum hoses 10 inside the appliance 2, FIG. 4 illustrates an optional carousel assembly 50 used for multiple distribution from a single an interior vacuum hose input port 33. Carousel assembly 50 generally comprises a stationery docking base 52 connected by vacuum hose 10 to an interior vacuum hose input port 33, and a rotating carousel 54 rotatably and removably mounted atop the stationery docking base 52. Stationery docking base 52 further comprises a circular platform for resting on the refrigerator shelf, and having a raised annular lip 57 for seating the rotating carousel 54. A single vacuum hose 10 is connected between an interior vacuum hose input port 33 and enters the docking base 52 at aperture 53, continuing there inside to a coupling with rotating carousel 54. The rotating carousel 54 further comprises a vertical stem 60 (to which the vacuum hose 10 is distally connected). Stem 60 is a vertical conduit with a series of evenly spaced support flanges 62 each attached to and supporting a corresponding circular platform 64, thereby form a multi-tiered carousel assembly 50. Each of flanges 62 further serves as an air passage to direct vacuum pressure outward from stem 60 to a series of vacuum hose connection ports 24 spaced radially around the flanges 62. The vacuum hose connection ports 24 allow connection of multiple vacuum hoses 10 (as seen at top) to apply vacuum pressure individually to each set of canisters 16 residing on the respective tiers of the multi-tiered carousel assembly 50. Flanges 62 may be formed as integrally-molded components essentially comprising hollow bounded disks with molded-in vacuum hose connection ports 24. The lowermost platform 64 is rotatably seated within the raised annular lip 57 of stationery docking base 52 for carousel operation. The foregoing configuration allows rotating of carousel 54 to provide easy access to any of the canisters 16 for vacuum-sealing thereof, and significantly conserves space.

Figure 5:
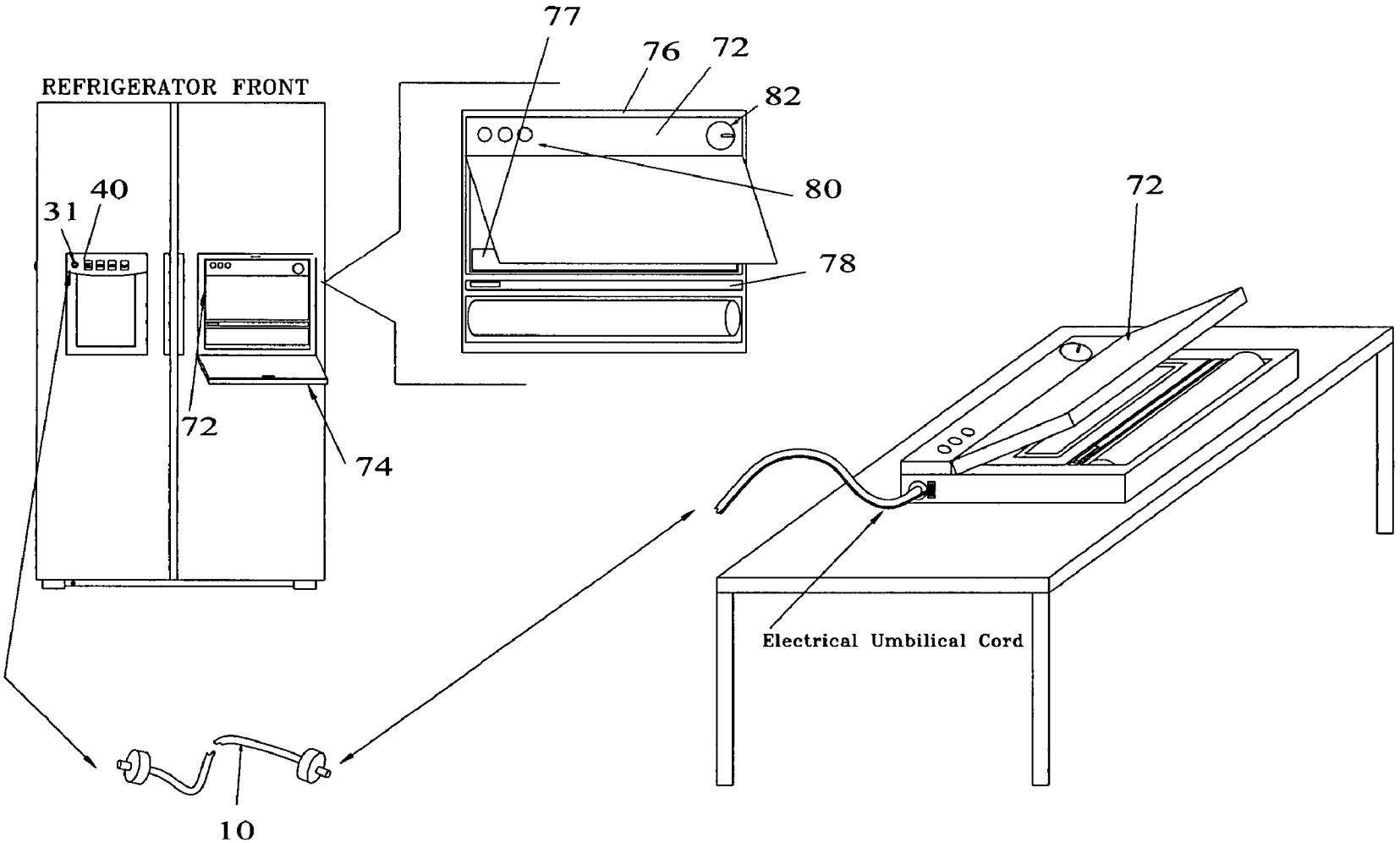
FIG. 5 is an alternative embodiment of the present invention, which includes an in-door bag-sealing unit 72 for vacuum packaging plastic bagging material.

FIG. 5 is an alternative embodiment of the present invention, which combines an in-door bag sealing unit 72 in combination with the above-described hose input port 31 and a vacuum control switch 40, thereby providing capability for both vacuum packaging plastic bagging material as well as sealing canisters 16. The in-door bag-sealing unit 72 is recessed within the door of the refrigerator 2, preferably occupying the door opposite that of the ice-maker in a double-door configuration. As seen in the enlarged inset (right), this is accomplished by providing an open faced housing 74 built into the refrigerator door for insertion of the in-door bag-sealing unit 72. Housing 74 includes a downwardly pivoting door 74 for concealing the in-door bag-sealing unit 72 and for providing a work surface thereon. The in-door bag-sealing unit 72 is preferably detachable from the housing 74, but may be permanently installed if desired. The in-door bag sealing unit 72 packages, seals and cuts bagging material in the same manner as that of conventional stand alone vacuum sealers such as the FoodSaver™ systems and the MagicVac™ systems, which are commercially available. The difference is that the in-door bag-sealing unit 72 derives power from the refrigerator power bus (120 VAC) and is coupled internally via an additional vacuum tube 38 (not shown) to the vacuum source (see FIG. 3) at the rear of the refrigerator 2. As with the conventional stand alone units, in-door bag sealing unit 72 includes an intake channel (obscured) to remove air from plastic bagging material, an optional bagging material cutter 78, a heating element 77 or like sealing strip for sealing the plastic bagging material, and a plurality of control switches 80 (i.e. a one-touch operation button that initiates both vacuuming out and sealing of bagging material, a manual seal button that stops vacuuming and seals on demand, a manual vacuum control button, etc.), as well as an on/off switch 82. In use, items to be vacuum packaged are placed inside an open bag, the open end of the bag is inserted into the unit in engagement with the intake port. Once the vacuum control switch is operated, the in-door bag-sealing unit 72 applies a predetermined vacuum to the bag, and seals and cuts the bag canister for keeping foods fresh.

A container or holding compartment may optionally be provided (attached to refrigerator 2 or as a recessed adjunct to the in-door bag sealing unit 72 or ice and water dispenser 3 in order to conveniently store a roll of bagging material.

As stated above, the in-door bag-sealing unit 72 is preferably detachable from the housing 74 for use as a remote tabletop unit. In this case, both the internal vacuum tube 38 and power connections may be extendable to reach a table or countertop, or the internal vacuum tube 38 may be detached and a separate vacuum hose 10 used to reconnect to the vacuum source (such as via vacuum hose input port 33 on the other side). This way the in-door bag sealing unit 72 may vacuum package, seal and cut bagging material in the same manner as that of conventional stand alone vacuum sealers such as the FoodSaver™ systems and the Magic-Vac™ systems, but it derives its vacuum force from the dedicated vacuum source 30.

The requisite vacuum force for all of the above-described embodiments may be created by either the dedicated vacuum source 30 or directly from the existing refrigerator compressor pump (not shown).

It should now be apparent that the above-described refrigerator with an integral vacuum sealer (either retrofit into exiting refrigerators or integrated into newly manufactured refrigerators) makes it much more convenient to seal vacuum bags and/or vacuum canisters because it is easy to use and easily accessible, and because it allows for sealing either at the refrigerator or remotely (detached) for countertop use.

Having now fully set forth the preferred embodiments and certain modifications of the concept underlying the present invention, various other embodiments as well as certain variations and modifications of the embodiment herein show and described will obviously occur to those skilled in the art upon becoming familiar with said underlying concept. It is to be understood, therefore, that the invention may be practiced otherwise than as specifically set forth in the appended claims.

We claim:

1. A combination refrigerator-vacuum sealer comprising:
a refrigerator having a compressor; and
a integrated vacuum sealing unit recessed into the door of said refrigerator, said unit comprising:
a vacuum source;
an air exhaust port; and
an optional intake port located on the outer surface of said unit and configured to receive a vacuum hose for vacuum packaging containers, an intake port located inside the unit and configured as a channel to remove air from plastic bagging material, an optional bagging material cutter, a sealing strip for sealing the plastic bagging material, and a plurality of control switches.

2. A combination refrigerator-vacuum sealer comprising:
a refrigerator having a compressor; and
an integrated vacuum sealing unit recessed into a frontal door of said refrigerator, said unit comprising:
at least one air intake port,
an air exhaust port,
at least one vacuum control switch mounted onto said frontal door; and
a vacuum source comprising, a vacuum pump piston assembly powered by an electric motor and controlled by said at least one vacuum control switch; said vacuum pump piston assembly is fluidly connected to said air intake port by an air intake vacuum hose and to said exhaust port by an output vacuum hose.

3. The combination refrigerator-vacuum sealer of claim 2, wherein said vacuum source comprises said refrigerator compressor.

4. A refrigerator having a power input, and at least one frontal door; and an integral vacuum sealer comprising:
a vacuum source selectably connectable to said power input for generating a vacuum pressure;
a vacuum control switch mounted on said frontal door for applying said power input to said vacuum source;
at least one vacuum port mounted on the refrigerator;
at least one internal hose housed in said refrigerator and in fluid connection between said vacuum source to said at least one vacuum port; and
an external hose connectable between said at least one vacuum port and a vacuum canister for vacuum sealing of said canister; and
a remote bagging unit connectable by said external hose to said at least one vacuum port for remote counter top plastic-bag sealing and cutting plastic bagging material.

5. The refrigerator with integral vacuum sealer according to claim 4, wherein said bagging unit is attached to said at least one door of said refrigerator and is connected by a second internal hose to said vacuum source for plastic-bag sealing.

6. The refrigerator with integral vacuum sealer according to claim 4, wherein said bagging unit is removably attached to said at least one door of said refrigerator for dual use as a built-in or remote counter top plastic-bag sealing apparatus.

7. The refrigerator with integral vacuum sealer according to claim 4, wherein said bagging unit comprises a heat-sealing strip and cutter.

8. A refrigerator having a power input, at least one frontal door; and an integral vacuum sealer comprising;
a vacuum source selectably connectable to said power input for generating a vacuum pressure;
a vacuum control switch for applying said power input to said vacuum source;
at least one vacuum port mounted mounted in the refrigerator cold compartment;
at least one internal hose housed in said refrigerator and in fluid connection between said vacuum source to said at least one vacuum port; and
an external hose connectable between said at least one vacuum port and a vacuum canister for vacuum sealing of said canister; and
a carousel assembly rotatably seated in the refrigerator cold compartment for storing vacuum canisters, and including
a stationery base,
a multi-tier shelf rotatably mounted on said base, and
a vacuum hose branch junction connectable to said vacuum port in the refrigerator cold compartment for branching to a plurality of external vacuum hoses.

* * * * *